US005388298A

United States Patent [19]

Rutter et al.

[11] Patent Number: 5,388,298

[45] Date of Patent: Feb. 14, 1995

[54] DEVICE FOR THE MACHINE WASHING OF CLOTHES AND THE METHOD OF UTILIZING SAID DEVICE

[75] Inventors: Philippa J. Rutter, Cardiff, United Kingdom; Henri Cornette, Pointoise, France; John Bailey, Newcastle Upon Tyne, England; Gerard Bocquet, Neuilly Sur Seine, France; Aude G. X. Bouraoui-Karoui, Strombeek-Bever, Belgium; Gilbert Laurenty, Paris; Jacky P. Duquet, Herbeville, both of France

[73] Assignee: The Procter & Gamble Company, Cincinnati, Ohio

[21] Appl. No.: 50,305

[22] PCT Filed: Nov. 25, 1991

[86] PCT No.: PCT/US91/08823

§ 371 Date: May 10, 1993

§ 102(e) Date: May 10, 1993

[87] PCT Pub. No.: WO92/09736

PCT Pub. Date: Jun. 11, 1992

[30] Foreign Application Priority Data

Nov. 30, 1990 [FR] France ..... 90 15065

[51] Int. Cl.[6] ..... D06F 39/02

[52] U.S. Cl. ..... 8/158; 68/17 R

[58] Field of Search ..... 8/137, 158, 159; 68/17 R, 235 R; 206/0.5, 216; 222/463, 476, 547, 564; 252/90, 174

[56] References Cited

U.S. PATENT DOCUMENTS

| | | | |
|---|---|---|---|
| 4,703,872 | 11/1987 | Cornette et al. | 222/158 |
| 4,720,351 | 1/1988 | Flynn et al. | 252/90 |
| 4,835,804 | 6/1989 | Arnau-Munoz et al. | 8/158 |
| 4,944,165 | 7/1990 | Leebeek et al. | 68/17 R |

FOREIGN PATENT DOCUMENTS

| | | |
|---|---|---|
| 2563250A1 | 10/1985 | France . |
| 2570720A1 | 3/1986 | France . |
| 2629433A3 | 10/1989 | France . |

*Primary Examiner*—Philip R. Coe

*Attorney, Agent, or Firm*—William Scott Andes; E. Kelly Linman; Dean L. Garner

[57] ABSTRACT

The measuring and dispensing device of the reusable type for the machine washing of clothes comprises a hollow body intended to receive the amount of a liquid detergent prescribed for a wash and provided with at least one filling opening (3) and with outlets (8) for distribution in the machine, as well as means (2, 2*a*; 10, 10*a*) enabling the user to effect, once the device has been filled, an easy and controlled application of detergent to selected areas of a garment before the latter is washed in the machine, in order to effect a pre-treatment of the areas before the washing cycle, the measuring and dispensing device, still containing the amount of product remaining after the pre-treatment, being introduced together with the clothes into the machine. The pretreatment means (2, 2*a*; 10, 10*a*) form an integral part of the device.

20 Claims, 16 Drawing Sheets

DEVICE FOR THE MACHINE WASHING OF CLOTHES AND THE METHOD OF UTILIZING SAID DEVICE

The present invention relates to a measuring and dispensing device of the reusable type for the machine washing of clothes, and also to the method of utilizing said device.

More particularly, the invention relates to a measuring and dispensing device, of a type which is now standard and which enables the method of machine washing of clothes described in the Applicant's Patent FR 2563250 to be carried out and is intended to be filled with at least one liquid detergent, thereupon being placed in the drum of the machine together with the clothes and then being progressively emptied of its contents in the course of the washing cycle. Measuring and dispensing devices of this kind have been described, inter alia, in the Applicant's patent application published under No. FR 2570720. This application concerns measuring and dispensing devices each of which comprises a body, particularly one of mainly spherical shape, which is intended to contain a detergent liquid and which has a filling opening and is associated with an attached assembly which may form a lid, capping said opening. Said attached assembly and/or said body is or are provided with outlets intended to permit the progressive discharge of the liquid amongst the clothes in the course of the washing.

It is known that, in order to obtain a good degree of cleanness, it is often necessary for certain areas of clothes, for example particularly soiled areas, such as individual spots, or areas habitually more heavily soiled, such as shirt collars and cuffs, to be treated before the wash. This pretreatment generally consists of simple prewashing with soap, in particular with a solid soap and a brush, so that the user must first provide himself with objects, namely the soap and the brush, other than those needed for the machine wash.

In this respect it should be noted that measuring and dispensing devices known hitherto and also the bottles containing detergent liquids intended for machine washing are unsuitable for enabling a user to pour detergent liquid onto a particular area of a garment in a sufficiently controlled manner.

In particular, large capacity containers are difficult to manipulate. It is therefore usually necessary to make use of separately presented pretreatment products, and containers for such products have been developed and are available on the market: products applied by spraying are for example known. Apart from inconvenience to the user, since two different containers must be used—one for the detergent and the other for the pretreatment product-pretreatment with an additional product increases the total cost of the wash.

The present invention seeks to obviate these disadvantages and provides a measuring and dispensing device incorporating pretreatment means making it possible to achieve controlled application of a detergent liquid, with which it has been filled for the purpose of the machine wash, to selected areas of a garment for the purpose of effecting the pretreatment of these areas before the washing cycle. The user therefore no longer needs to provide an object or a container which would be used solely for this specific pretreatment stage. Such pretreatment means may for example comprise means making it possible to pour out a controlled amount of liquid detergent onto the areas to be treated, such as spouts or nozzles, optionally with additional means enabling a user to treat such areas by rubbing, such as irregularities formed on the measuring and dispensing device. The invention is obviously applicable to all types of measuring and dispensing devices, particularly to those of the multi-compartment type intended to contain a plurality of constituents which are not mutually compatible to a satisfactory extent.

The object of the present invention is therefore a measuring and dispensing device of the reusable type for the machine washing of clothes, which comprises a hollow body closed at one end by a base and intended to receive the amount prescribed for the washing of at least one useful product, such as a liquid detergent or a washing additive, said hollow body being provided with at least one filling opening and with outlets for the distribution of said product or products, the said device being intended to be placed, with the clothes to be washed, in the drum of the machine, where it is progressively emptied of its contents in the course of the washing cycle, and being characterized in that it is provided with means enabling a user to effect, once said device has been filled, an easy and controlled application of at least one product contained in it to selected areas of a garment, before the latter is washed in the machine, in order to effect a pretreatment of such areas before the washing cycle, the measuring and dispensing device, containing the amount of product remaining after the pretreatment, being introduced together with the clothes into the machine, and in that said pretreatment means form an integral part of said device.

According to an advantageous characteristic of the invention the device is filled at the start with the entire amount of useful product, such as the liquid detergent, required for a washing cycle. A fraction of the contents of the device is applied during the pretreatment to the selected areas of garments. The residual amount of product is distributed, in the course of the wash, by the measuring and dispensing device placed in the machine together with the clothes. It will be noted that the total amount of useful product will thus be brought into contact with the clothes, namely the amount applied to the area of garments during the pretreatment and the amount contained in the device and distributed from the latter. It has surprisingly been found that the invention thus achieved even greater effectiveness in respect to stain removal because of the pretreatment, although the amount of product consumed is the same as with the prior art described at the beginning of the present description.

Another advantageous feature is that at the end of the washing cycle the entire device leaves the machine in a completely clean state and can be reused immediately, whereas in the case of known pretreatments residues and spots of product were always left on the application means used, unless a separate pretreatment product container was used, with the previously mentioned disadvantages of this known technique.

The present invention also relates to the following characteristics, considered singly or in all their technically possible combinations:

the pretreatment means comprise means enabling a controlled amount of product to be poured out onto areas of garments requiring pretreatment;

the means enabling a controlled amount of product to be poured out comprise a pouring spout or a nozzle leading to the outside of the device;

the pretreatment means comprise a pouring spout leading to the outside of the device and ending in a channel which is in communication with the interior of the device;

the pouring spout is distant from the base of said device, while the channel passes substantially radially through the wall of the body of said device;

the pouring spout is close to the base of said device;

the channel terminating in the pouring spout extends in the walls of an assembly attached to the body of said device, capping its filling opening, while at the opposite end to that where the pouring spout is located said channel leads into the interior of the device;

the pretreatment means comprise means enabling a user to apply treatment by rubbing to the areas of the garment requiring pretreatment;

the body of said device is provided with irregularities projecting from the wall on which they are formed;

said irregularities are grooves or striations and/or are small studs provided on the base of the container;

surface irregularities are provided on the wall of the container in the immediate vicinity of the pouring spout or nozzle;

the center plane of the filling opening of the device is inclined in relation to the center plane of its base, while the pouring spout or the nozzle is disposed in a zone of said device at the level of which said opening is most distant from said base;

the body provided with gripping depressions;

the device is divided internally by walls intended to prevent accidental pouring out of a product which is not desirable for the pretreatment;

the body of said device is divided internally by walls which in its interior delimit a plurality of compartments each intended to receive a different active product;

the device comprises in its interior at least one measuring marker;

said marker is of adjustable height in relation to the base of the device.

The descriptions given below of various embodiments of the invention are purely illustrative and non limitative. They must be read in conjunction with the accompanying drawings, in which.

Figure 1:
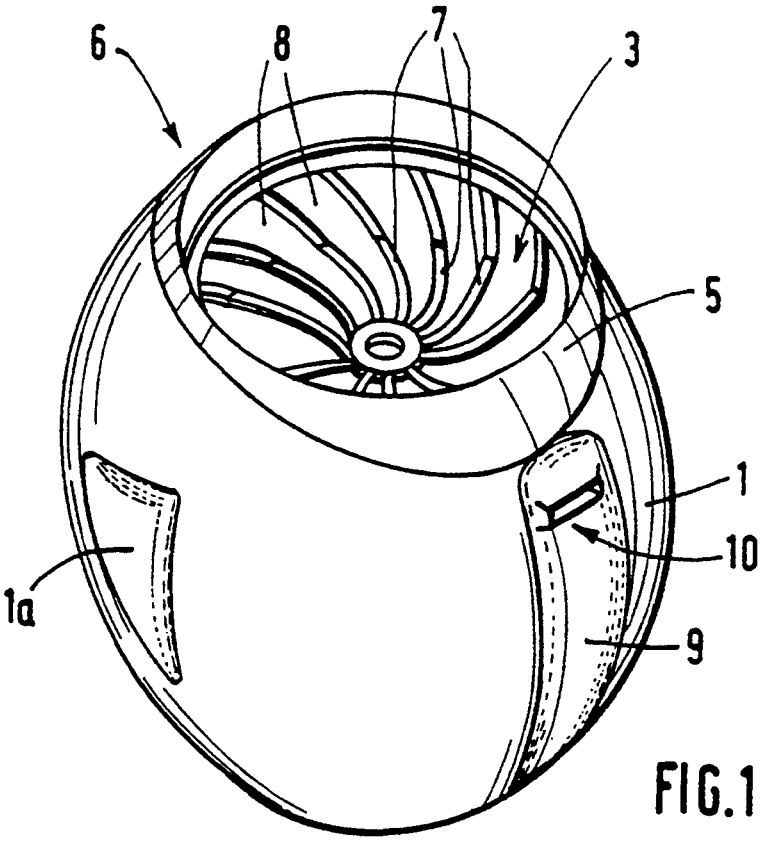
FIG. 1 is a view in perspective of a measuring and dispensing device according to a first embodiment of the invention.
Figure 2:
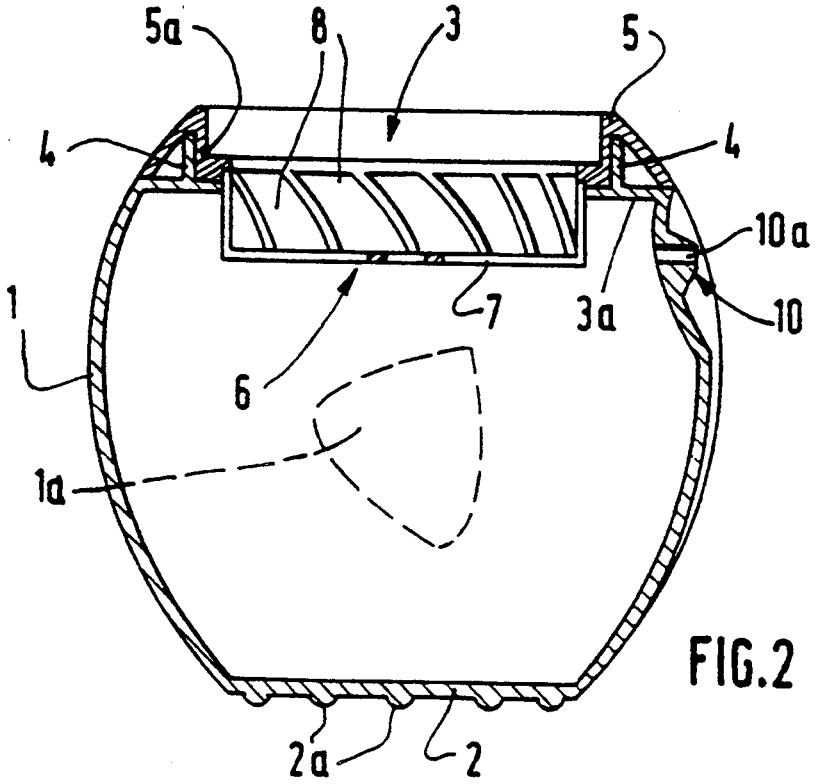
FIG. 2 is a view in axial section of the measuring and dispensing device shown in FIG. 1.

FIGS. 1 and 2 show a measuring and dispensing device according to a first embodiment of the invention, which comprises a hollow body 1 of revolution, of mainly spherical or slightly ellipsoidal shape, closed at one end by a base 2, which is a flat surface, and, opposite said base 2, provided with a circular opening 3 surrounded by a rim 3*a*. This opening 3 is bordered by an annular cylindrical support skirt 4 extending from said rim 3*a* towards the outside of said body 1. This support skirt 4 receives an annular collar 5 serving as a means for clipping to an attached assembly 6. In addition to this collar 5, the attached assembly 6 comprises a basket 7 which forms a helical web at the level of the opening of the body 1. The cavities bounded by the branches of this helical web constitute outlets 8 through which the product filled into said body will progressively escape during the washing cycle.

The body 1 is provided with a re-entrant groove 9 arranged on its outer wall and extending over substantially the entire height from its collar 4 to the base 2, said groove 9 being of slight depth and slight width. At the top, close to the opening 3, this groove 9 is associated with a pouring spout 10 which projects slightly in relation to said groove 9. The opening of said spout 10 is in the form of a flat slit and is in communication with the interior of the body 1 by way of a channel 10*a*.

In addition, the base 2 is provided on its outer face with small studs 2*a*, which constitute irregularities intended to permit the rubbing of areas of a garment which are to be treated. The body 1 of the measuring and dispensing device has a shape perfectly suitable for gripping by the user's hand, and for this purpose has two depressions 1*a* disposed one on each side of the pouring spout 10.

A dispenser device of this kind is used in the manner which will now be described. The user first fills this device with the detergent liquid which he intends to use for the machine washing, in accordance with the dosage prescribed by the maker. He can then pretreat certain areas of the garment by pouring a little detergent liquid onto those areas by inclining the body 1. The detergent liquid passing through the channel 10*a* then passes out of the body 1 through the spout 10, which the user will direct and position so as to obtain the desired distribution of the detergent liquid over the areas which are to be pretreated. When the user considers that a sufficient amount of liquid has been poured for an area which is to be pretreated, he stops the flow of the detergent liquid by tilting the body in the opposite direction, and he can rub the preselected area of the garment with the aid of the outer surface of the base 2 and of the irregularities 2*a* formed on that surface. The user then uses the dispenser device substantially like a brush, the manipulability of the device being facilitated by the depressions 1*a*, which enable the device to be gripped most effectively. When the pretreatment stage has been completed, the user places the measuring and dispensing device in the drum of the washing machine together with the clothes, the detergent liquid which remains in the body 1 progressively escaping through the outlets 8 in the course of the washing cycle.

As previously mentioned, the total amount of washing product is the same as that used in a known device not provided with pretreatment means. This amount corresponds in fact to the fractions used during the pretreatment and the amount dispensed during the washing cycle. In addition, the device equipped with the means described leaves the washing machine in a clean state and can be recovered for reuse.

Figure 3:
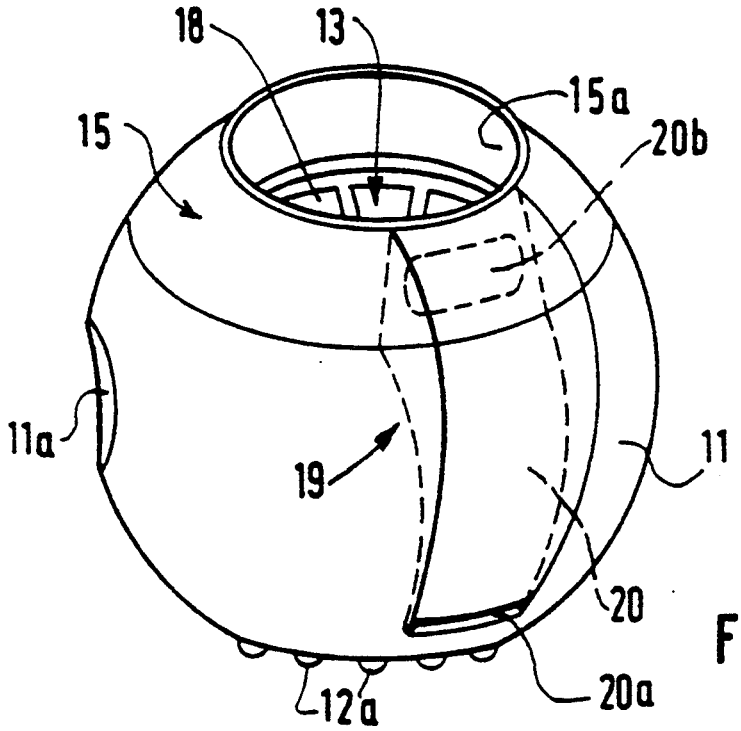
FIGS. 3 and 4 are views in perspective and in axial section of a measuring and dispensing device according to a second embodiment of the invention.
Figure 4:
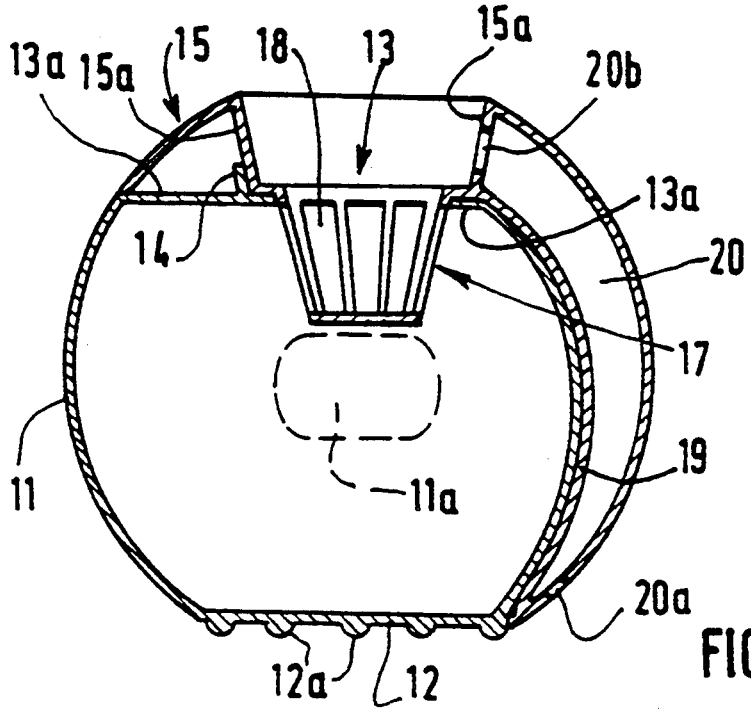

Referring now to FIGS. 3 and 4, it is seen that a measuring and dispensing device according to a variant embodiment of the invention comprises a body 11 of mainly spherical shape, which terminates at one end of a flat surface 12 constituting its base, and at its other end has an opening 13 capped by an attached assembly 16. This attached assembly 16 is engaged by means of a collar 15 over a skirt 14 bordering the opening 13 in the body 1.

The walls of the body 11 are provided with a depression 19 extending from the base 12 to the rum 13*a* carrying the skirt 14, the main wall of this depression 19 ending, in its part most distant from the base 12, substantially at the level of the contour of the opening 13. This depression 19 is intended to receive a horn-shaped channel 20 integrally moulded with the collar 15; the inside walls of this channel 20 match the shape of the walls of the body 1 at the level of said depression 19. At this bottom end the horn-shaped channel 20 leads out, near the base 12, to the outside of the device by way of an opening 20*a* forming a pouring spout. At its other end said channel 20 leads through an opening 20*b* to the interior of the measuring and dispensing device. The opening 20*b* is formed in the wall 15*a* of the collar 15, the latter being engaged over the skirt 14 by means of said wall. This horn-shaped channel 20 has in its center plane passing through the axis of the body 11 a crescent-shaped cross section widening out from its end on the base 12 towards the wall 15*a* and the opening 20*b*.

In the interior of the body 1 said wall 15*a* is extended by a frustoconical chimney 17 provided over its entire periphery with outlets 18 formed in the side wall of the truncated cone 17. Depressions 11*a* enable the device to be conveniently gripped on each side of the horn-shaped channel 20.

The device in the variant shown in FIGS. 3 and 4 is used in the manner which will now be described.

In order to effect the pretreatment, after the device has been filled with detergent liquid through the opening 13 and the frustoconical chimney 17, the user slightly tilts the device so that the channel 20 and the opening 20*a* are in a lowered position relative to the remainder of the device. The detergent liquid then passes from the body 11 into said channel 20 by way of the opening 20*b* and then flows out of said channel through the spout 20*a*, which the user directs in order to distribute the detergent liquid in a controlled manner over the areas of the garment which it is considered should be pretreated. When a quantity of detergent liquid thought to be sufficient has been deposited on one of these areas, the user tilts the measuring and dispensing device in the opposite direction and can rub the area in question with the irregular outer face of the base or flat surface 12. Once this pretreatment of the garment has been carried out, the measuring and dispensing device is placed in the drum of the machine together with the clothes. In the course of the washing cycle the detergent liquid progressively escapes from the said device through the outlets 18 and the opening of the chimney 17. Once again, it can be seen that the device leaves the machine in a perfectly clean state and can be directly reused.

Figure 5:
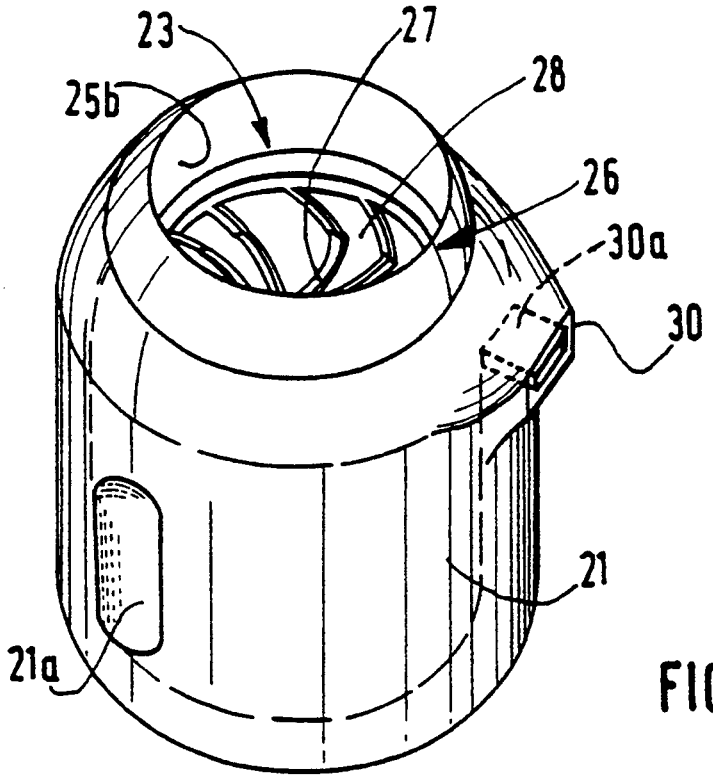
FIGS. 5 and 6 are respectively a view in perspective and a view in axial section of a measuring and dispensing device according to a third embodiment of the invention.
Figure 6:
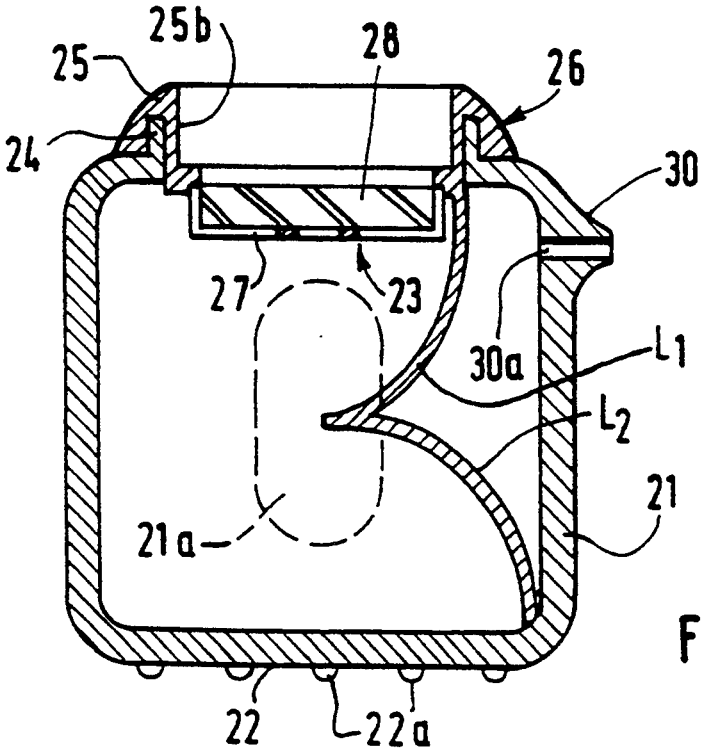
Figure 7:
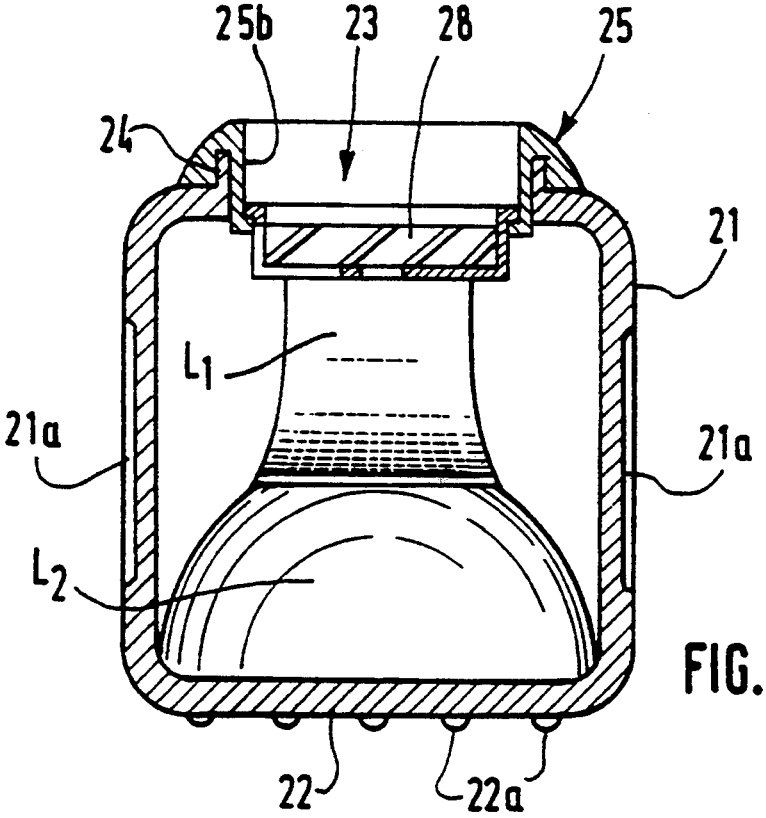
FIG. 7 is a view in section on the line VII—VII in FIG. 6.

Referring now to FIGS. 5 to 7, it can be seen that a measuring and dispensing device according to another possible variant of the invention comprises a body 21 of mainly cylindrical shape, provided with a base 22 and an opening 23, said body 21 thus forming a container. In addition, substantially similarly to the variant illustrated in FIGS. 1 and 2, this device comprises:

an attached assembly 26 which comprises a collar 25 engaged over a support skirt 24 and bordering the opening 23 of the body 21, as well as a helical web 27;

a pouring spout 30 which projects in relation to the outer cylindrical faces of the body 21 and is in communication with the interior of the device by way of a channel 30*a* passing radially through the cylindrical wall of the body 21 in a zone of said wall which is distant from the base 22 and close to the opening 23.

The cylindrical wall 25*b*, which fits internally into the support skirt 24, is extended inside the device by an incurved tongue L1 or deflector extending from the side of the wall 15*b* which is closest to the channel 30*a* towards the axis of the body 21 and the base 22, its end more distant from the collar 25 being situated substantially at the level of said axis, at the middle of the height of the body 21 and its tangent plane being substantially parallel to the base 22. The deflector L1 is completed by a dome or shoe L2 substantially of the shape of a hollow quarter-sphere, said shoe L2 having a semi-circular contour at the level of the base 22, corresponding to the semicircular inside contour of said base 22, and being disposed on the same side of the device as the tongue L1. This shoe L2 may for example be integrally moulded on the body 21 or else be of a material enabling it to be introduced into the body in a deformable shape and to become rigid after it has been introduced into the container.

The device shown in FIGS. 5 and 6 is used in the manner which will now be described. It is more particularly intended to receive two products useful for the washing, one of them in powder form and the other in liquid form. The produce in liquid form is the one of the two products which is intended to be used during the pretreatment stage. The user then pours the powder into the interior of the body 21, the powder sliding over the face of the tongue L1 directed towards the opening 23, falling onto the base 22 and being at least partially distributed under the dome L2. Once the necessary amount of powder has been introduced into the body 21, the user fills the body L1 with detergent liquid, which falls into the body 21 without excessively mixing with the powder. The user can then carry out the pretreatment of areas of the clothes, operating substantially in the same manner as with the device illustrated in FIGS. 1 and 2, that is to say using the pouring spout 30 to distribute the detergent liquid over the areas of the clothes which he considers should be treated, and then optionally rubbing these areas with the aid of the base 22 of the body 21, said base being provided with irregularities. During this tilting movement the powder is retained in the body 21 by the shoe L2, and only the detergent liquid is poured out through the channel 30*a* and the spout 20. When this pretreatment has been completed, the device has only to be placed inside the drum of the machine, and the useful product in powder form and the detergent liquid will escape from the said device, during the washing cycle, through the outlets 28 which between them delimit the branches of the helical web 27.

Figure 7A:
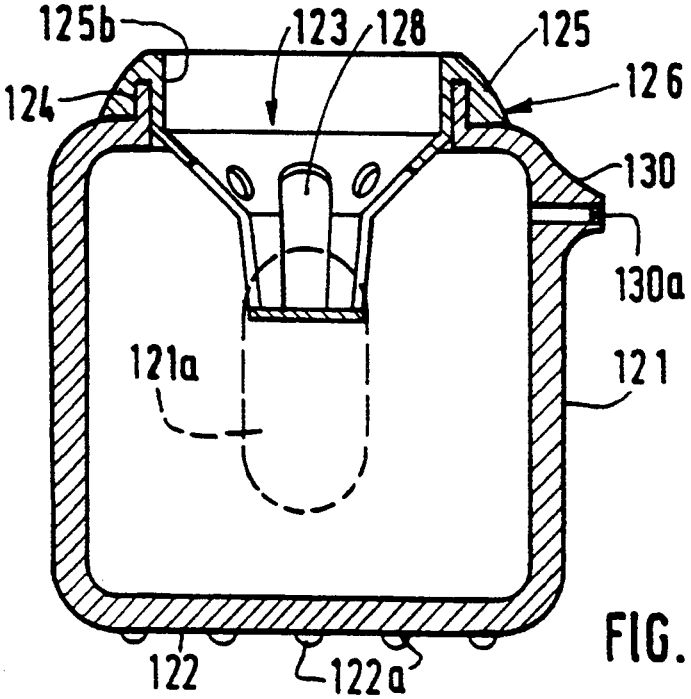
FIG. 7A is a view in axial section of another variant of the invention.

The device shown in FIG. 7A is very similar to that shown in FIGS. 5 to 7, and for the elements of the device shown in said FIGS. 5 to 7 which are found again in the variant shown in FIG. 7A the same reference numerals are used again, increased by 100.

This device, which in its interior has neither a deflector nor a shoe, comprises a cylindrical body 121 and an attached assembly 126 provided with a chimney 127 having outlets 128. A channel 130*a* ending, outside said body, in a spout 130 passes through a part of the body 121 distant from the base 112.

The mode of utilization of the variant illustrated in FIG. 7A is very simple. During the pretreatment the user has simply to incline the body 121 in order to pour out through the spout 130 the desired amount of detergent liquid. It will be noted that, as shown in the drawing, the mouth of the spout 130 may be provided with means enabling the flow of detergent liquid to be controlled or slowed down. Such means may for example consist of a grid or sieve.

Figure 8:
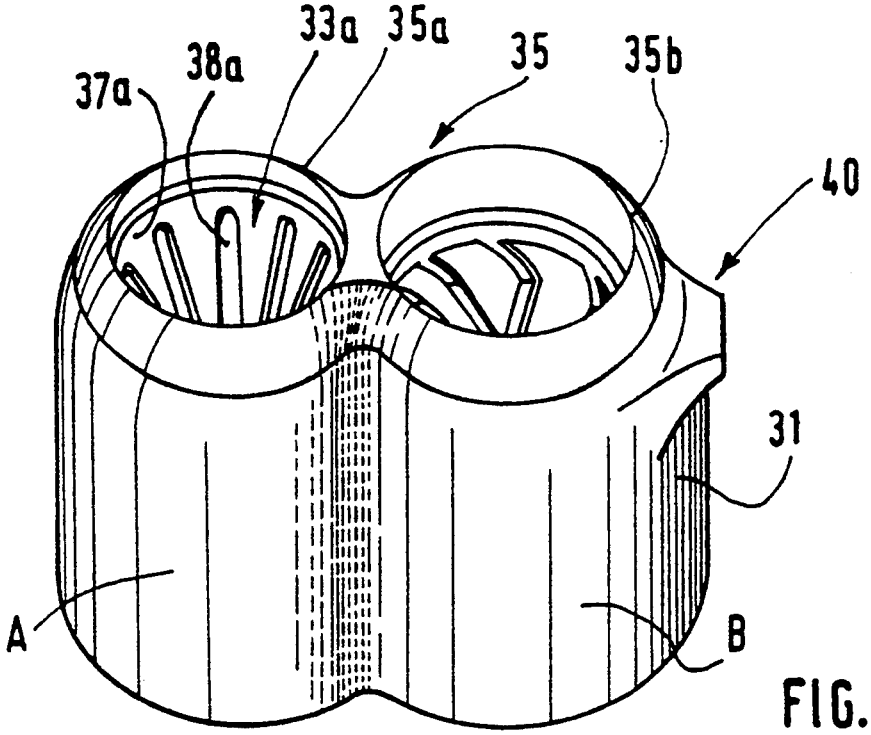
FIGS. 8 and 9 are respectively a view in perspective and a view in axial section of a two-compartment measuring and dispensing device according to a fourth embodiment of the invention.
Figure 9:
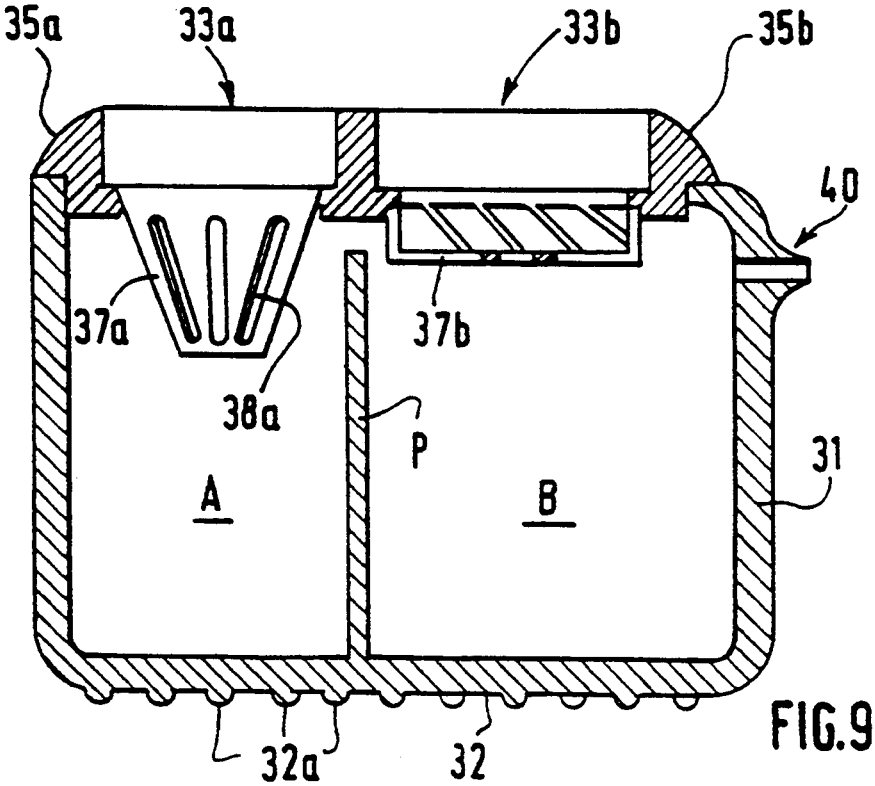

Referring now to FIGS. 8 and 9, it can be seen that a measuring and dispensing device according to yet another possible variant of the invention comprises a main body 31 in the form of two cylinders disposed side by side along a common wall P delimiting, inside the body 31, two compartments A and B, of which one (A) has a slightly smaller diameter than the other (B). On this body 31, which terminates at one end in a base 32 and at its other end has two openings 33*a* and 33*b*, is disposed an attached assembly 36 comprising two collars 35*a* and 35*b* joined to form a single piece 35 and respectively matching the edges of the body 31 which delimit the contour of the compartment A and the contour of the compartment B, said two colg the edges of b being joined at a common wall in line with the wall P delimiting the two compartments A and B in the body 31. The collar 35*a* is associated with a chimney 37*a* of frustoconical shape, which is provided with elongated slits 38*a* regularly distributed over its periphery and extending along generatrices of said chimney 37*a*. The collar 35*b* is in turn provided with a helical web 37*b* of the type already described above. In its zone at the greatest distance from the compartment A the compartment B is provided with a spout 40, the shape and arrangement of which one the walls of the body 31 are substantially the same as those of the spout 30 on the walls of the body 21 of the device shown in FIGS. 5 to 7.

The utilization of the device described here is substantially similar to that of the devices shown in FIGS. 1 and 2, and in FIGS. 5 to 7, in respect of its principle, except that the user first fills each of the compartments A and B separately, filling the compartment B with the detergent liquid which is to be used for the pretreatment of clothes, while the compartment A is filled with a liquid or powder product used for washing but not compatible with the detergent liquid with which the compartment B is filled.

The height of the wall P separating the compartments A and B is selected, in dependence on the dimensions of said compartments, in such a manner that the contents of compartment A will not be poured out accidentally when the device is tilted to pour out the product contained in compartment B.

Figure 10:
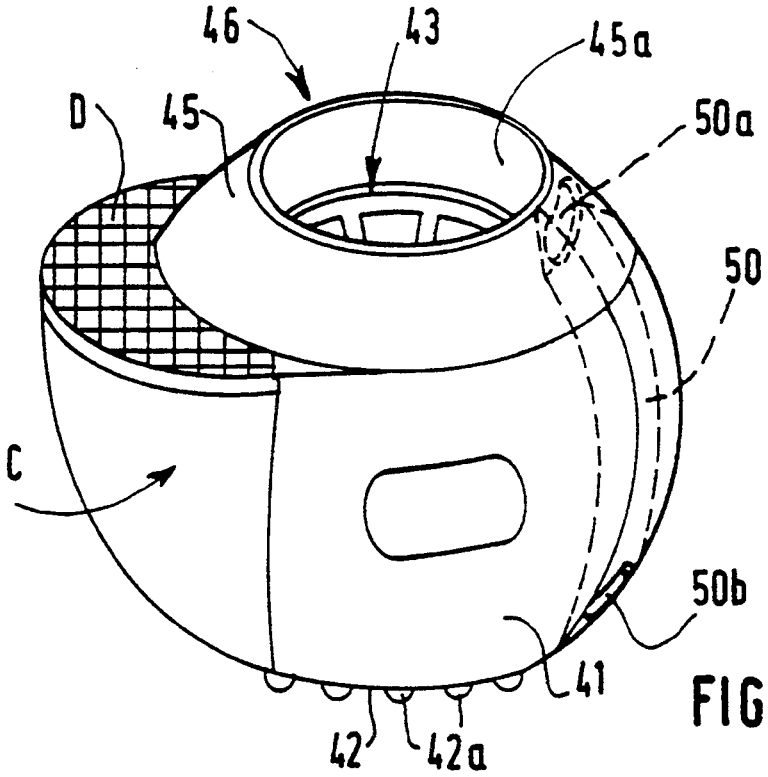
FIGS. 10 and 11 are respectively a view in perspective and a view in axial section of a two-compartment measuring and dispensing device according to a fifth embodiment of the invention.
Figure 11:
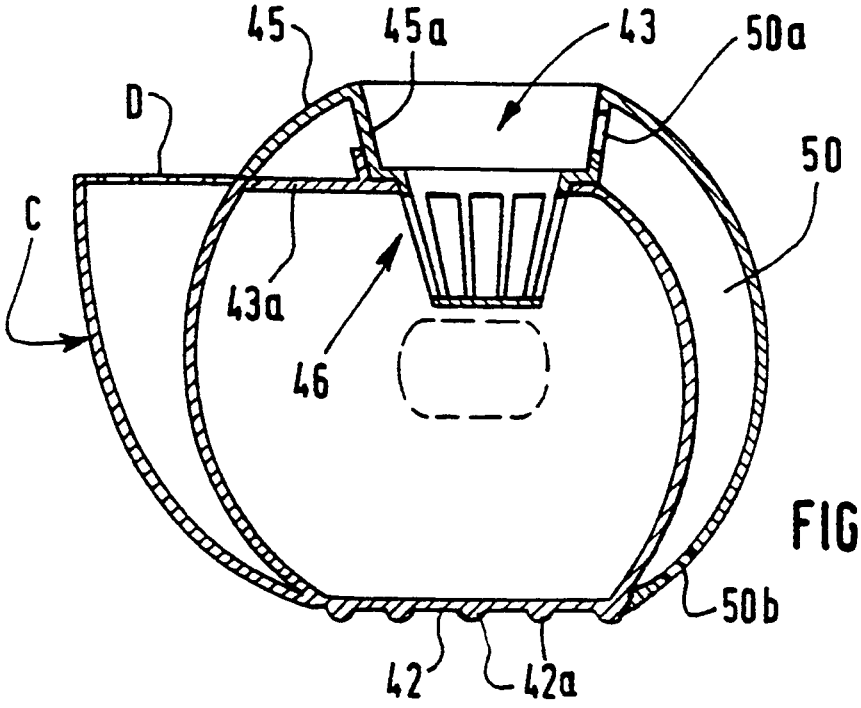

Referring now more particularly to FIGS. 10 and 11, it can be seen that a measuring and dispensing device according to a fifth embodiment of the invention is of the general type of the device provided with a horn-shaped channel shown in the previously described FIGS. 3 and 4, and comprises in particular a body 41 associated with an attached assembly 46, in which the wall 45*a* of the collar 45, by which the assembly is held on the body 41, is provided with an opening 50*a*, at the level of which a horn-shaped channel 50 has its outlet, through its other end at the level of an opening 50*b* forming a pouring spout disposed towards the base 42 of the device. The wall delimiting said horn-shaped channel 50 on the inside is the wall of the body 51.

The device of this new variant differs from the device shown in FIGS. 3 and 4 in that it has a secondary compartment C intended to receive, for example, a bleach in liquid or powder form, this secondary compartment C being delimited on the one hand by the outer face of the wall bounding the inside of the body 41, and on the other hand by an incurved wall which extends from the base 42 substantially to the plane of the opening of the body 41. The wall delimiting the chamber C diverges from the outer wall of the body 41 at the base 42 and as far as the plane of its opening. This chamber C is also provided at its opening contour with a grid D the mesh of which delimits outlets intended to permit both the filling of this chamber C before the wash and the progressive evacuation of the product contained in it in the course of the washing cycle.

The utilization of a device of this kind is substantially similar to that of the device shown in FIGS. 3 and 4, the only difference, where the user is concerned, consisting of the initial filling of each of the two compartments of the device with suitable products which cannot be previously mixed, the body 41 receiving in its interior mainly the detergent liquid intended to be used for the pretreatment phase.

Figure 12:
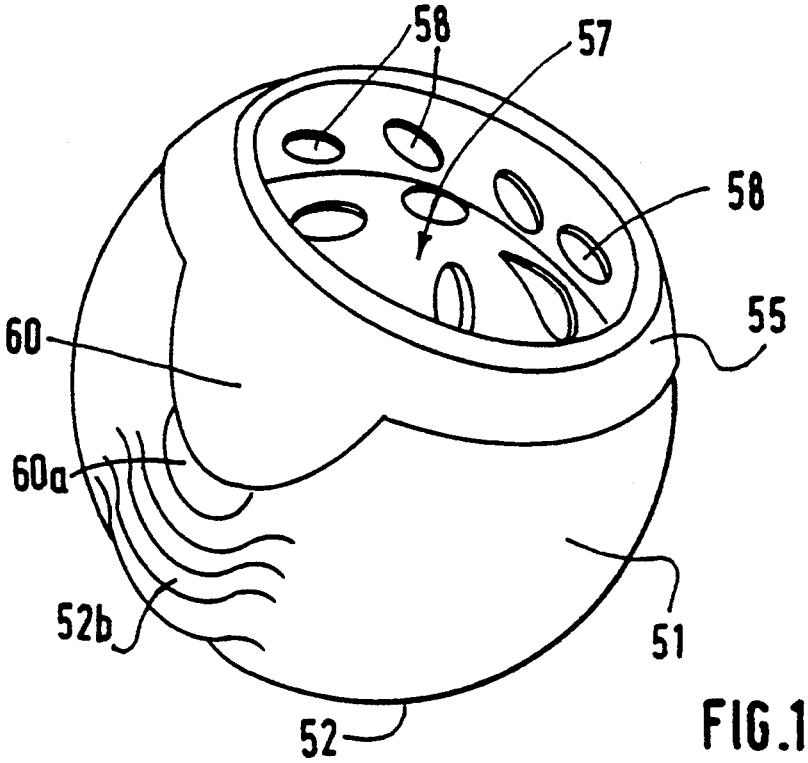
FIGS. 12 and 13 are respectively a view in perspective and a view in axial section of a measuring and dispensing device according to a sixth embodiment of the invention.
Figure 13:
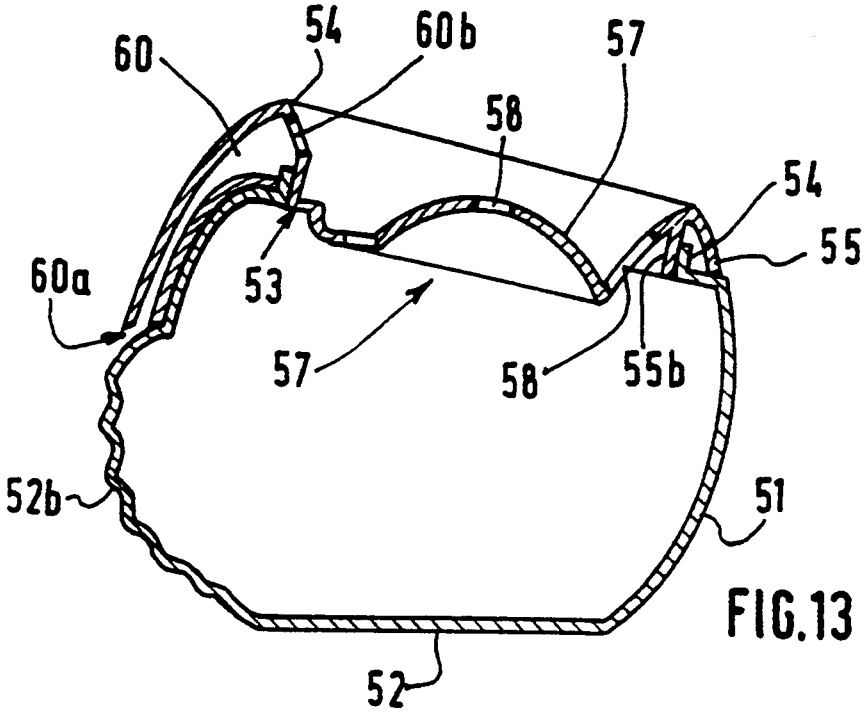

FIGS. 12 and 13 show a measuring and dispensing device according to a sixth embodiment of the invention. This device comprises essentially a body 51 forming, in conjunction with a base 52, a container intended to receive a detergent liquid utilizable both for the pretreatment phase and for the washing cycle. The body 51 of this container has mainly spherical, slightly oblong shape. Its opening 53 at the opposite end to its base 52 is disposed in a plane slightly inclined relative to the plane of said base 52. As previously, this opening 53 is bordered by a skirt 54 intended to cooperate with a complementary wall 55*b* provided on the collar 55 of a lid 57 associated with said container for the purpose of holding said lid on said opening 53. The lid 57 comprises, additionally to the collar 55, a base which, for example for aesthetic reasons, may have a slightly irregular shape but which extends along the inclined plane of the opening 53 of the body 51, this lid base being provided with outlets 58 distributed over its entire surface, as well as over the wall 55*b* of the collar 55, intended to cooperate with the skirt 54. In its zone of maximum height the body 51 is provided with striations or grooves 52*b* extending on the periphery of said body 51 substantially to the base 52 of said body. At the level of this zone the lid 57 is associated with a horn-shaped channel 60 matching the rounded or incurved shape of the body 51 of the device. This horn-shaped channel 60 ends at the level of an opening forming a pouring spout 60*a*. At its other end is situated an opening 60*b* formed in the wall 55*b* of the collar 55. The pouring spout 60*a* is disposed above the zone provided with the striations or surface irregularities 52*b*.

This measuring an dispensing device is used in the manner which will now be described. The user first fills the container 51. Before passing to the washing stage, the user may if desired effect the pretreatment of certain areas of the clothes by pouring detergent liquid by tilting the device, in such a manner that the liquid passes through the opening 60*b* and the pouring spout 60*a*. It is to be noted that the fact that the principal plane of the contour of the opening 53 is slightly inclined in relation to the base 52 of the device makes it possible to avoid accidentally pouring out the liquid when the device is placed on a flat horizontal surface before the pretreatment, the opening 60*b* being then situated above the level of the liquid. Once the liquid has bene spread over an area of the clothes, the user can treat that area by rubbing, by moving the striations 52*b* to-and-fro over said area of the garment, the device then being slightly straightened in relation to its previous position, so that the level of the detergent liquid in the container 51 is below the opening 60*b*. When the user has completed the pretreatment phase, he places the device in the drum of the washing machine together with the clothes. In the course of the washing cycle the detergent liquid passes progressively out of the measuring and dispensing device by way of the outlets 58 provided in the lid 57.

Figure 14:
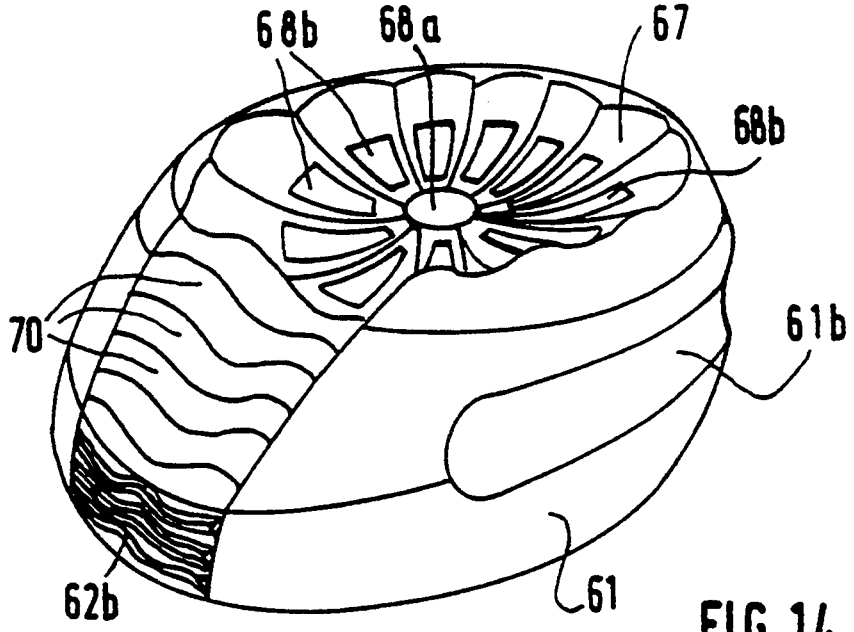
FIGS. 14 and 15 are respectively a view in perspective and a view in axial section of a device according to a seventh embodiment of the invention.
Figure 15:
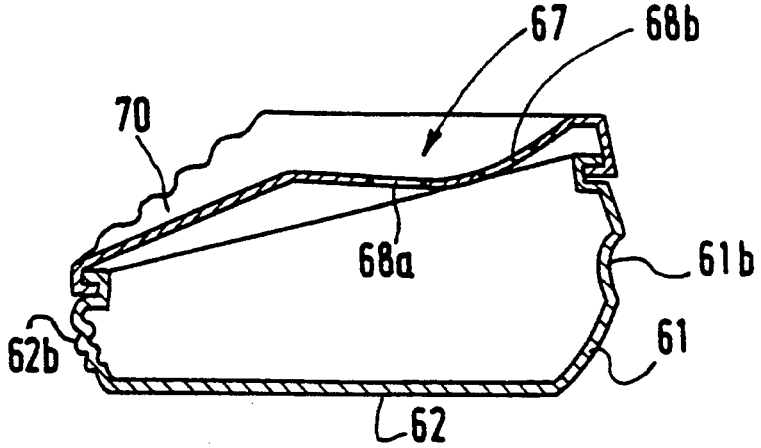

A seventh measuring the dispensing device is also shown in FIGS. 14 and 15. As can be seen in these figures, this device comprises a main body 61 having a shape of revolution delimited by generatrices extending from the contour of an elliptical base. The body 61 is associated with a lid 67, which has a concave profile in the direction of the base 62 and which is provided at its center with a main filling opening 68*a*, around which elongated outlets 68*b* extend radially, the body 61 and its lid 67 being provided with a spout 70, which is a depression extending over the greater part of the height of the container 61 from the concave part of the lid 67. At the end of said spout 70 close to the base 62 the outside walls of the body 61 may be provided with protuberant striations 62*b* just below the spout 70. The body 61 is in addition provided with a semi-annular depression 61*b* disposed oppositely to said spout 60 and intended to permit better gripping of the entire device.

A measuring and dispensing device of this kind is used in the manner which will now be described. The user fills the container with detergent liquid by way of the openings 68*a* and 68*b*. He can pretreat selected areas of a garment by pouring detergent liquid onto these areas by tilting the entire device so that the detergent liquid, passing through the openings 68*b* facing the spout 60, is poured from the latter onto the areas to which the user wishes to apply said liquid. He can then apply rubbing with the aid of the striated surface 62*b*. Once the pretreatment has been completed, the device is introduced into the drum of the machine together with the clothes.

Figure 16:
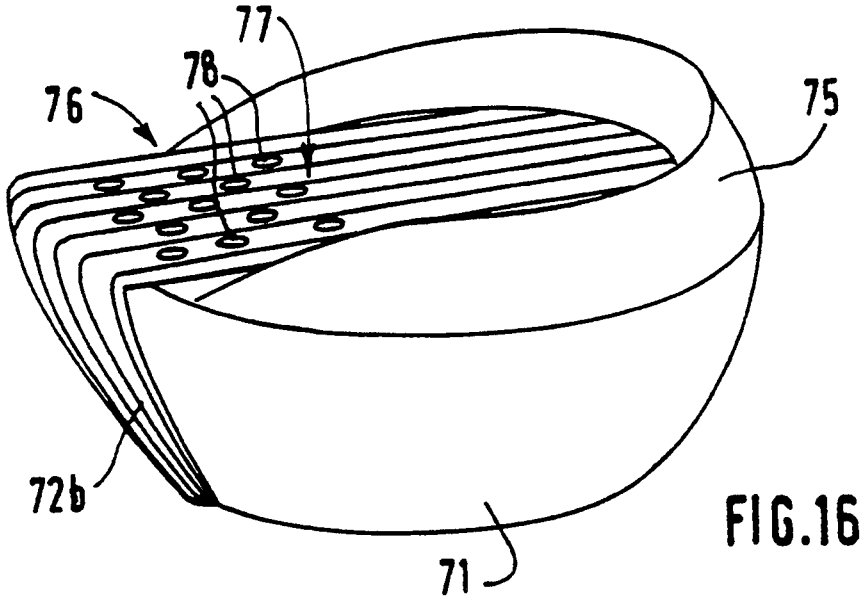
FIGS. 16 and 17 are respectively a view in perspective and a view in axial section of a measuring and dispensing device according to another embodiment of the invention.
Figure 17:
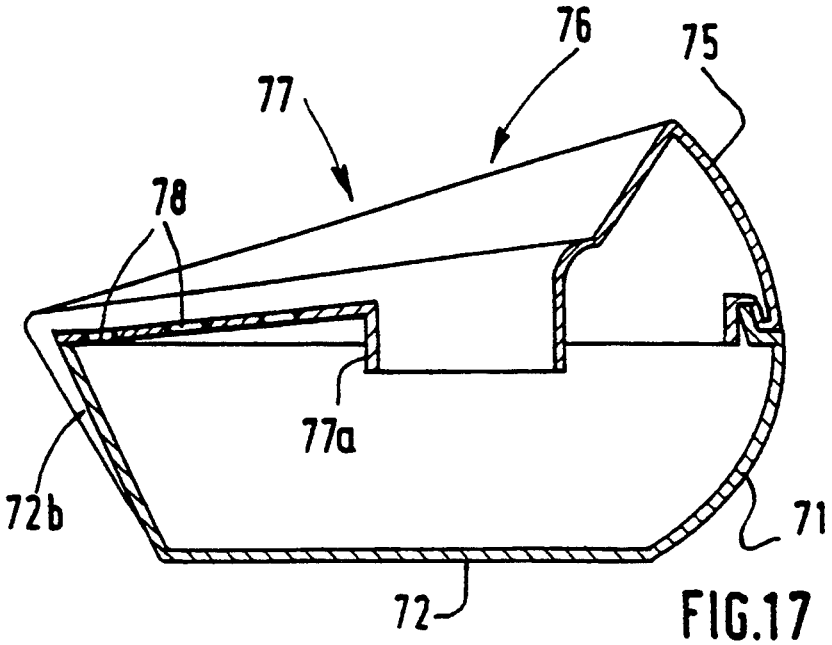

FIGS. 16 and 17 further show a measuring and dispensing device according to an eighth possible variant of the invention. The body 71 of the device has the shape of a frustoconical cradle at its front part and ends in a wall having substantially the shape of an arc of a sphere at its rear part. The lid 76 associated with it comprises a collar part 75 and a part 77 forming a spout. This spout 77 is associated with a cylindrical neck 77*a* extending from said spout 77 towards the bottom 72, and is mainly composed of a striated surface 77*b* which extends from the bottom of the collar 75 to the front of the device and is extended onto the front edge of the body 71 (striations 72*b*). The front part of the neck 77*a* has its outlet at the level of the bottom of the grooves in the surface 77, while its rear part has its outlet at the level of the top parts of the grooves which constitute said surface 77. At its front part this surface 77 has holes or outlets 78 passing through it.

For the purpose of filling this device, the user pours out the detergent liquid from the container constituted by the body 71 together with its base 72. Once the lid 76 has been placed in position, the user can then pretreat particularly soiled areas of the clothes by tilting the entire device forwards, so that the detergent liquid passing through the neck 77*a* and the holes 78 is carried into the grooves of the striated surface 77 *b* to the surface on which the user wishes to apply the detergent liquid. He can then carry out the treatment by rubbing said surface with the aid of the part 72*a* of the striated surface 77*a* situated at the front of the body 71. When the pretreatment has been completed, as previously it is then only necessary to place the entire device, together with the clothes, in the drum of the machine. In the course of the washing the detergent liquid will escape through the outlets 78 and the neck 77*a*.

Figure 18:
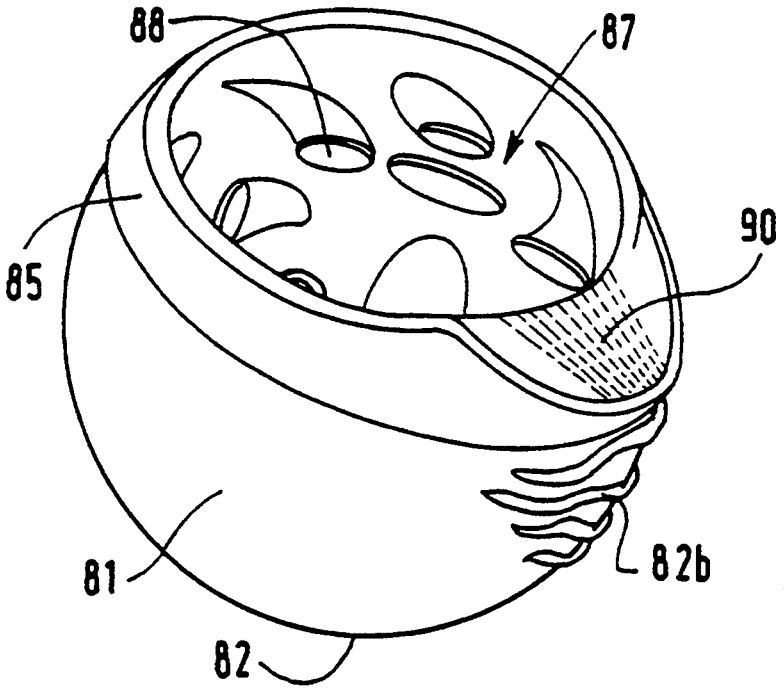
FIGS. 18 and 19 are respectively a view in perspective and a view in axial section of a measuring and dispensing device according to another embodiment of the invention.
Figure 19:
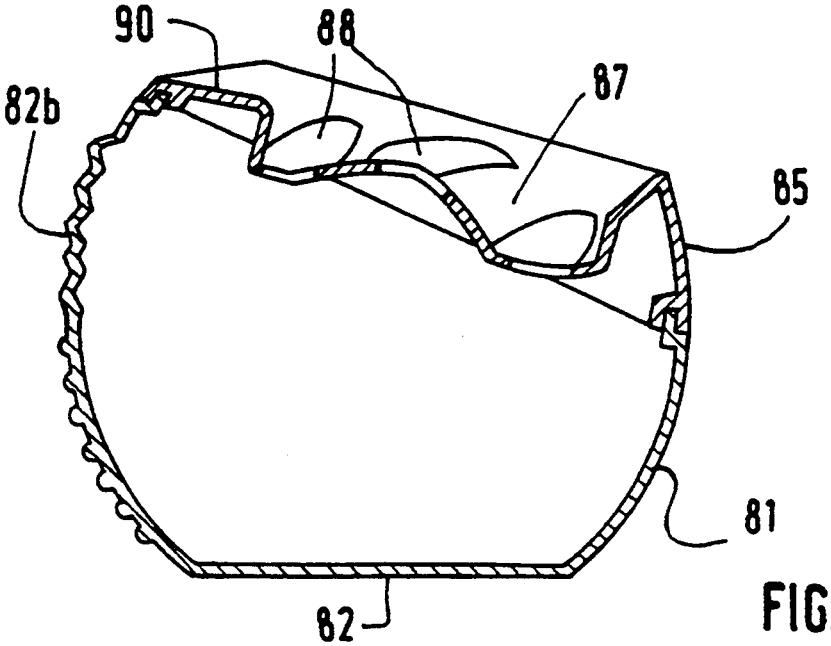

The ninth possible variant embodiment of the invention, which is illustrated in FIGS. 18 and 19, is very similar to that shown in FIGS. 12 and 13, since the body 81 of the device is provided, on a front part of greater height, with striations 82*b* which extend over contour peripheries one above the other from the base 82 to the lid 87. This lid 87 is provided with outlets 88. On its front part it is provided with means 90 intended to permit a controlled pouring of the detergent liquid, said means being a simple spout having an incurved base. The utilization of a device of this kind is derived from the utilization of the device shown in FIGS. 12 and 13.

Figure 20:
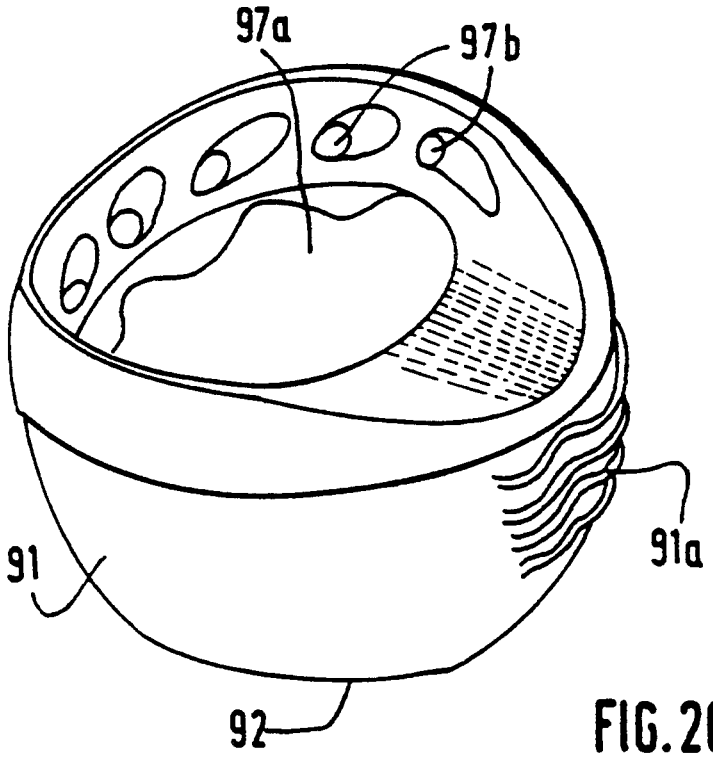
FIGS. 20 and 21 are respectively a view in perspective and a view in axial section of a measuring and dispensing device according to another embodiment of the invention.
Figure 21:
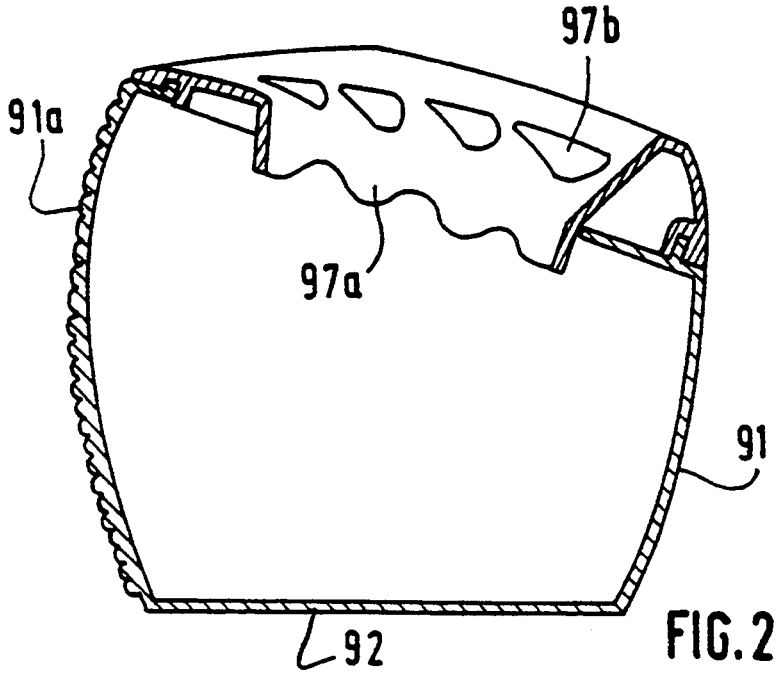

The device according to a tenth variant of the invention, which is shown in FIGS. 20 and 21, is very close to that shown in FIGS. 18 and 19, from which it differs essentially in that the lid 96 with which it is equipped has at its center a filling opening 97*a* of large diameter, this opening 97*a* being supplemented by small openings 97*b* serving as outlets for progressive evacuation of the detergent liquid in the course of the washing.

Figure 22:
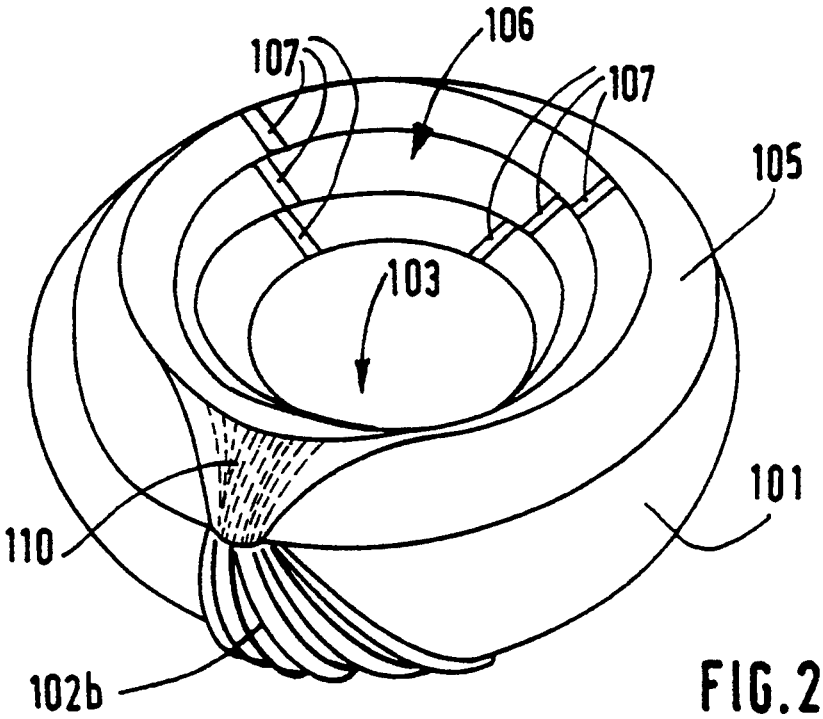
FIGS. 22 and 23 are respectively a view in perspective and a view in axial section of a measuring and dispensing device according to another embodiment of the invention.
Figure 23:
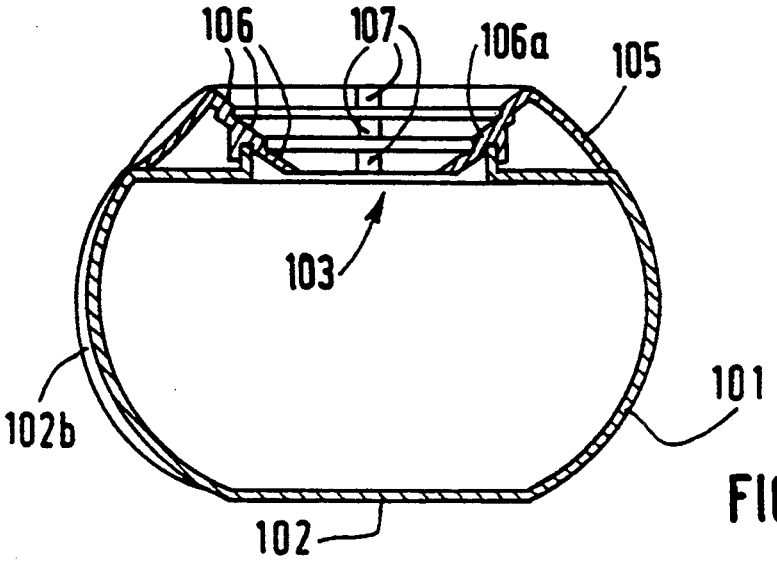

FIGS. 22 and 23 further show a device according to an eleventh embodiment of the invention. The body 101 of this device has a substantially crushed, mainly spherical shape between its opening 103 and its base 102 in the form of a flat surface. This body is associated with a lid 106 the lower rims of which delimit an opening which widens out from the interior of the body 101 towards the outside, said rims consisting of a succession of superposed frustoconical steps 106*a* which are provided with slits 107 intended to serve as outlets to enable the body 101 to empty progressively in the course of a washing cycle. This lid 106 also has a spout 110 projecting slightly in relation to the walls of the body 101. The body 101 is in turn provided, below said spout 110, with striations or grooves 102*b* extending from said spout 110 to the base 102. The utilization of this device is also inspired by that of the previously described devices.

Figure 24:
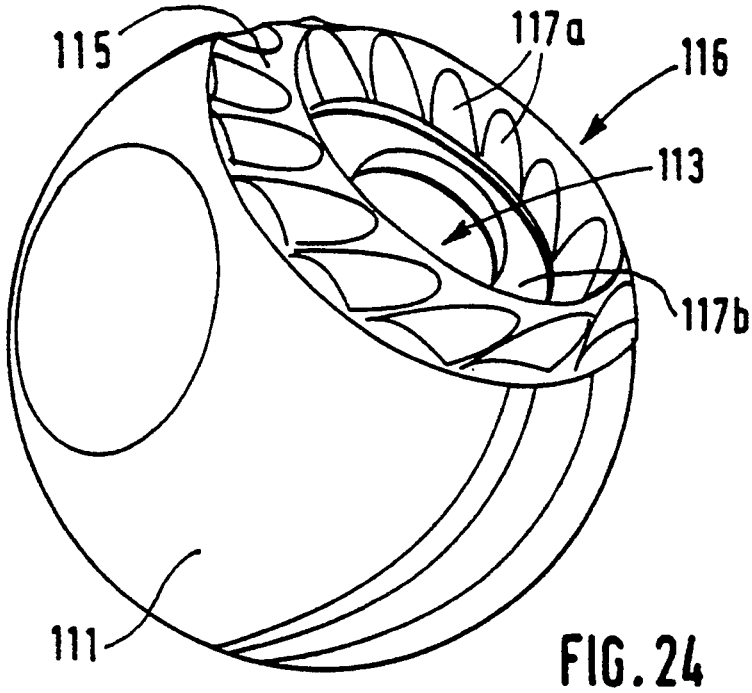
FIGS. 24 and 25 are respectively a view in perspective and a view in axial section of a measuring and dispensing device according to another embodiment of the invention.
Figure 25:
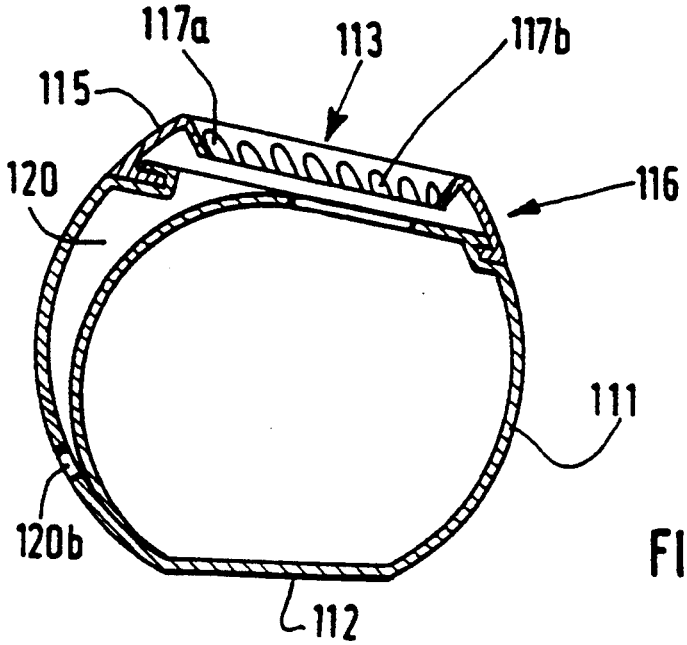

A device according to a twelfth variant of the invention is further shown in FIGS. 24 and 25. This device comprises a spherical body 111 having a base 112 and an opening 113 slightly inclined relative to said base. An assembly 116 having a collar 115 provided with openings 117*a* an da main opening 117*b* is attached over the opening 113. In its interior the body 111 is provided with a wall E, likewise having the shape of an arc of a circle and extending from its base to its opening and, in conjunction with the outer wall, delimiting a chimney-like channel 120 provided towards the base 112 with an opening 120*b* leading to the outside of the device. This device is used substantially similarly to the mode of utilization of the devices already described: in order to distribute the detergent liquid over areas of the garment which are to be pretreated, the user inclines the device towards the front, where the chimney-like channel 120 is associated, so that the liquid passes into said channel 120 and out of the latter at its opening 120*b*. Once the liquid has been distributed, the user can effect pretreatment by rubbing the garment with the front part 112*b* of the device.

Figure 26:
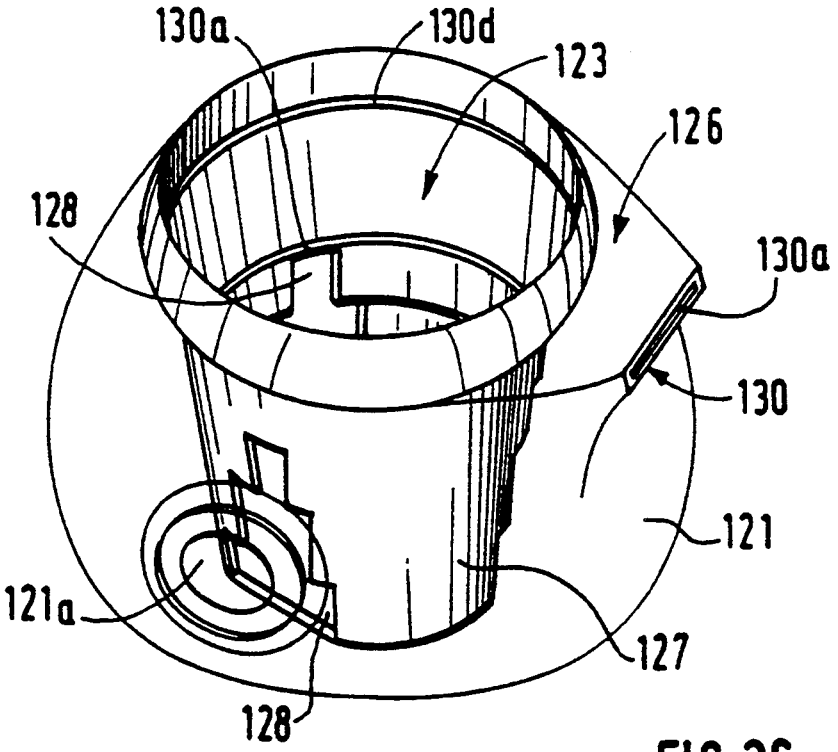
FIGS. 26 and 27 are respectively a view in perspective and a view in axial section of a measuring and dispensing device according to yet another embodiment of the invention.
Figure 27:
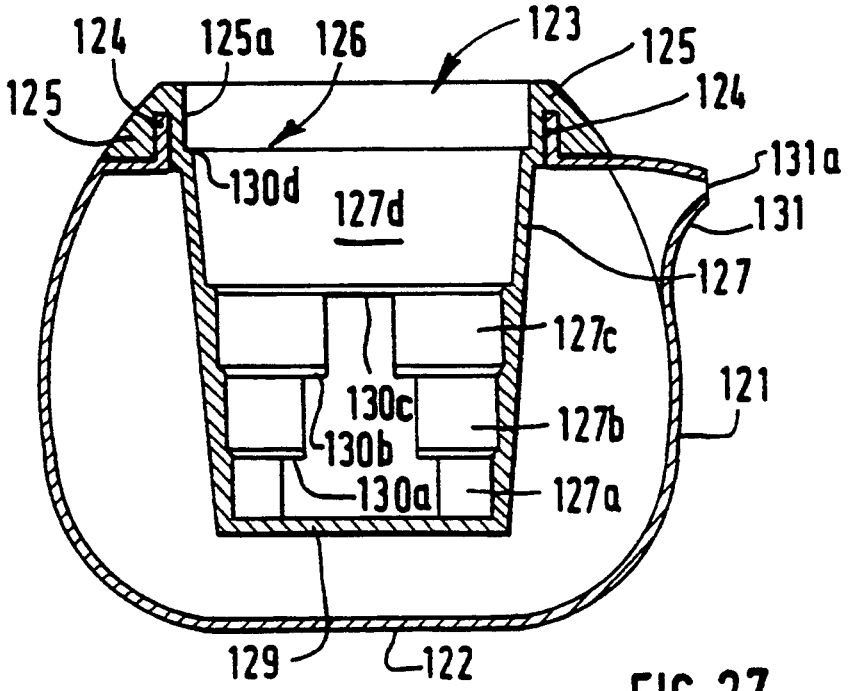

A device according to a thirteenth possible embodiment of the invention is further shown in FIGS. 26 and 27. This device comprises mainly a hollow body 121, of mainly spherical shape, provided with a base 122 and with a circular opening 123 surrounded by a rim 123*a*. This opening 123 is bordered by an annular cylindrical support skirt 124. This skirt 124 receives an annular collar 125 serving as a means for clipping to an attached assembly designated as a whole by the reference 126. In addition to this collar 125, this assembly 126 comprises a chimney with outer walls in the form of a truncated cone 127 extending in the interior of the body 121 from the opening 123 to a base 129 which terminates it, said base 129 being close to the base 122 and parallel thereto. This base 129 forms the small base of the truncated cone 127, the walls of said truncated cone 127 being continued beyond its large base, which is situated substantially at the level of the rim 123*a* and parallel to the base 122, by a cylindrical wall 125*a* of the annular collar 125, this wall 125*a* matching the internal walls of the support skirt 124. This wall 125*a* and the part of largest diameter of the truncated cone 127 are separated from one another by an annular setback 130*c* which is visible to an operator looking at the device from above. The diameter of the cylindrical wall 125*a* is, for this reason, slightly greater than the largest diameter of the truncated cone 127.

The walls which define this truncated cone 127 in its interior comprise four successive parts of revolution designated, from the base 129 towards the opening 123, by the references 127*a* to 127*c* respectively. The inner walls which define the parts 127*a* to 127*c* are cylindrical, the inside diameter of the part 127*b* being slightly greater than that of the part 127*a*, the diameter of the part 127*c* being slightly greater than that of the part 127*b*. The part 127*c* has, for its part, a frustoconical internal shape, the small diameter of which is slightly greater than the diameter of the part 127*c*. Thus, the four parts 127*a* to 127*c* are separated from one another, in pairs, by annular setbacks which have been designated by the references 130*a*, 130*b* and 130*c* respectively and which, just like the setback 130*c*, are circles which are visible to an operator when he looks at the entire device from above. Three openings 128 are formed in the walls of the chimney in the form of the truncated cone 127. These three openings 128 are of identical shape and are distributed regularly over the said part 127. They each extend form the base 129 to the annular setback 130*c*. These openings 128 are shaped in the form of pyramids with three tiers. The opening portions 128*a* to 128*c* corresponding to them at the level of the parts 127*a* to 127*c* are of mainly rectangular shape and are centered on one and the same axis of symmetry, the portion 128*a* being wider than the portion 128*b*, which is itself wider than the portion 128*c*.

At the top, the body 121 is provided with a pouring spout 130 which projects in relation to the main shape of said body 121. This pouring spout is provided with an opening 130*a* which is a flat slit.

The body 121 has a shape which is particularly suitable for manual gripping of the device by a user, and for this purpose has two depressions 121*a* disposed symmetrically on the body 121 in relation to the pouring spout 130.

A device of this kind is used in the manner which will now be described. It is initially in place on the cap of a bottle of liquid detergent, now shown. It is held on said cap in a conventional manner, for example by clamping its internal walls on the external walls of said caps. For this purpose, the entire device may be made, more particularly, of a flexible plastic material. The user can thus easily detach the entire device from the bottle on which it is presented, and then fill the device with liquid detergent. The detergent is poured through the opening 123 into the truncated cone 127 and passes through the openings 128 into the envelope 121. The annular shoulders 130*a* to 130 *c* serve as filling indicators for the user of the device. The user will be able to adjust the measured quantity of liquid detergent in his/her device depending upon the type of wash which is to be carried out.

After this filling stage, the user will be able to carry out a pretreatment of the clothes by spreading the detergent liquid over areas thereof which are more particularly stained. For this purpose, the user will tilt his/her device forwards so that the liquid passes through the opening 130 *a* of the spout 130. The device will have been gripped by way of the gripping depressions 121*a*. The pretreated clothes and the device are then placed together in the drum of the machine. The amount of detergent liquid which will be used during the washing cycle will thus correspond to that which has initially been measured out by the user and which is to be found mainly in the device, but also partly on the pretreated clothes.

Figure 28:
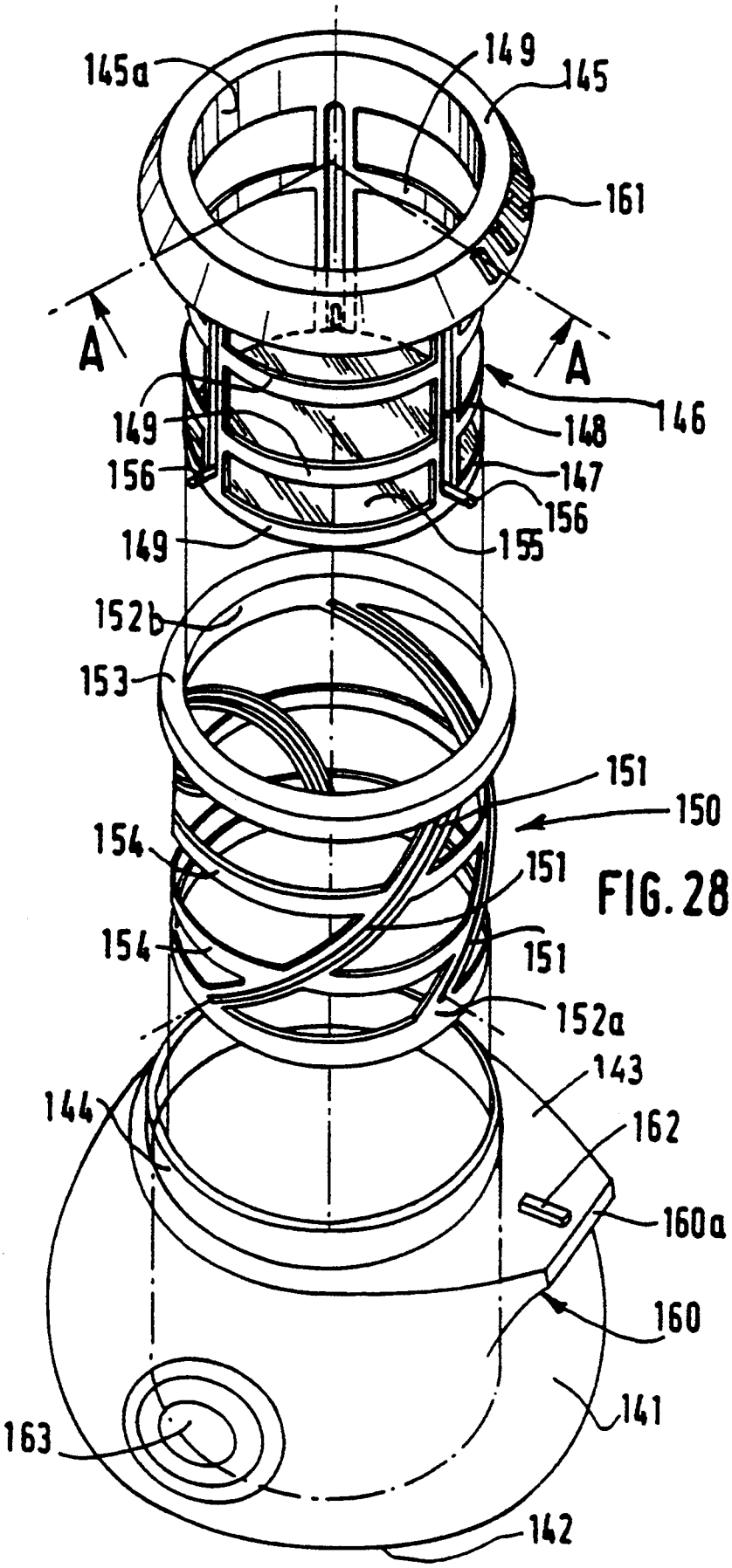
FIG. 28 is an exploded view in perspective of a measuring and dispensing device according to another possible embodiment of the invention.
Figure 29:
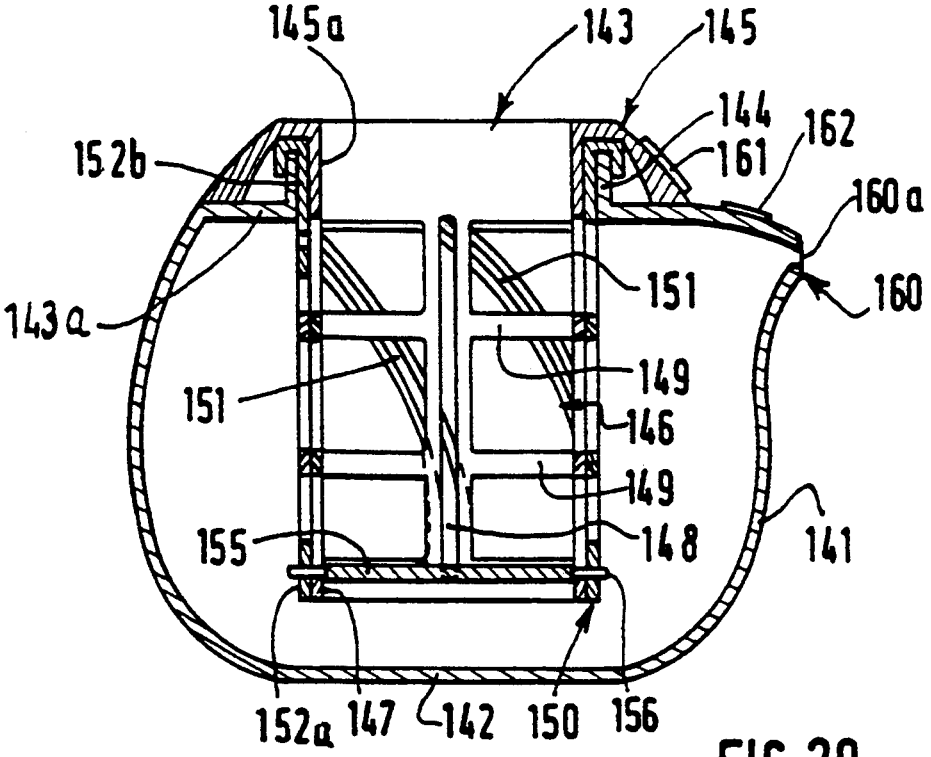
FIGS. 29 and 30 are view in section of the device in FIG. 28 on the line of section indicated in these figures, in two different use positions.
Figure 30:
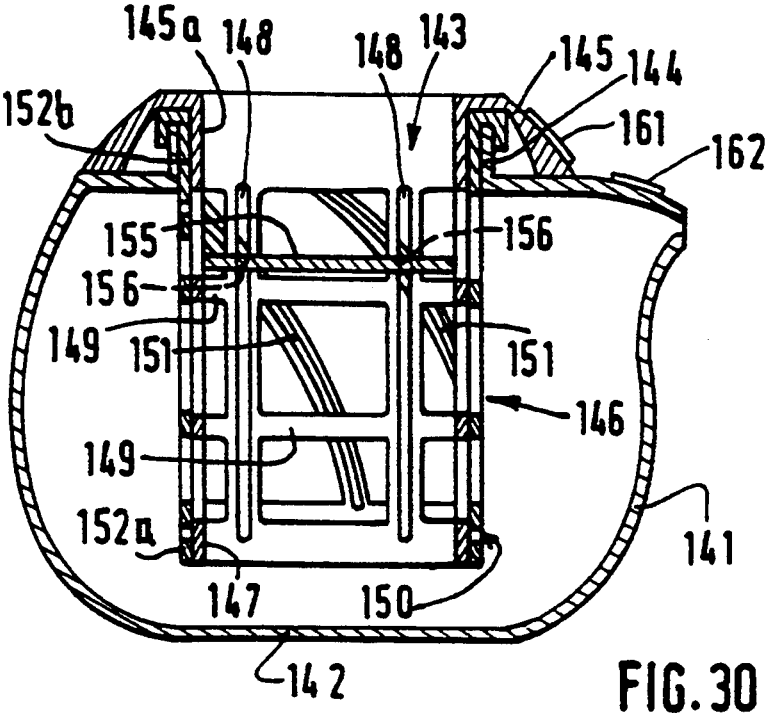

Reference will now be made to FIGS. 28 to 30. The measuring and dispensing device shown there comprises a body 141 of mainly spherical shape, having a base 142 and a circular opening 143 surrounded by a cylindrical skirt 144 extending perpendicularly to the rim 143*a* formed by said body 141 at the level of said opening. Said rim 143*a* is parallel to the base 142. Attached to this skirt 144 and to the opening 143 are, on the one hand, an assembly 150 which is snapped onto said skirt 144 and, on the other hand, an assembly 146 provided with a collar 145, the inner wall of which cooperates, by clamping, with the wall of the assembly 150, in order to hold said assembly 146 in relation to the entire device and to the opening 143, while allowing said collar 145 and the assembly 146 to pivot in the circular opening 143. The assembly 150 is a guiding framework of mainly cylindrical shape. On its contour there are defined three helical guiding slots 151 distributed uniformly over its periphery and extending between a lower hoop and an upper hoop 152*a* and 152*b* of the assembly 150. The upper hoop 152*b* carries the edge 153 which is snapped onto the skirt 144. The helical braces on which the slots 151 are formed are interconnected by braces 154 which form, for the framework 150, two intermediate hoops between the lower and upper hoops 152*a* and 152*b*.

The assembly 146 is likewise of general cylindrical shape. It comprises, for its part, between the above mentioned cylindrical wall 145*a* and a lower hoop 147, three straight slots 148 extending in braces perpendicularly to the main plane of said hoop 147 up to the cylindrical wall 145*a*. The braces which carry these slots 148 are interconnected by two intermediate hoops 149. The slots 148 and their braces are likewise distributed uniformly over the periphery of the assembly 146. When the assembly is fitted together, each slot 148 is opposite one, and only one, slot 151.

The assemblies 146 and 150 are associated with a plate 155 which is a disc, the diameter of which corresponds substantially to the internal diameter of the assembly 146. This disc 155 is provided with three pins 156 which are disposed radially in relation to said disc 155, extending outwards from the contour of said disc. These pins 156 have dimensions which enable them to be inserted into the slots 148 and 151 with which they cooperate.

The body 141 of the device is provided with a pouring spout 160, the opening of which is a slit 160*a*. The external wall of the collar 145 is provided, for its part, opposite this pouring spout 160 with a plurality of projecting markers 161, whereas the wall of the rim 143*a* is provided with a fixed marker 162 which is disposed symmetrically in relation to the spout 160. Depressions 163 are disposed on the body 141 on each side of the pouring spout 160. These depressions 163 are intended to permit gripping of the entire device.

A device of this kind is used in the manner which will now be described. The structure of this device permits a user, by pivoting the attached assembly 146 about the axis of the body 141 by manipulation of the collar 145, to adjust the position of the base 155 in relation to the body 141 and to the assemblies 146 and 160. When the assembly 146 is driven to pivot on itself, the pins 156 and the disc 155 are likewise driven in rotation about the same axis. The helical slots 151 formed in the assembly 150 drive said pins in an upward movement in the slots 148 formed in the assembly 146.

When an operator wishes to use a measuring and dispensing device of this kind, he/she first adjusts the heights of the plate 155 in relation to the assemblies 146 and 150 and to the body 141 by turning the collar 145 and the assembly 146 about the axis of said body 141 in order to make that of the markers 161 which appears to correspond to the wash which he/she desires coincide with the marker 162. He then fills the device with washing liquid, using the plate 155 as a filling marker. He/she can then carry out a pretreatment of the clothes by distributing liquid, via the spout 160 and its opening 160*a* over the stains on said clothes which appear stubborn. Once this pretreatment has been carried out, he/she positions the device in the drum of the washing machine together with the clothes. The amount of liquid which will be used for the washing cycle will be that which he/she initially measured out using the plate 155 as a marker, since this amount will correspond to the amount distributed over the pretreated parts of the clothes and to the amount remaining in the device.

The embodiments described above with reference to the accompanying drawings constitute only illustrations of the means according to the invention and other variants are possible by modification of the shapes of the device and of the pretreatment means associated with it. In view of the fact that the device is intended to serve as a dispenser after it has been placed inside the drum of the machine, it must not have any sharp edges capable of damaging the clothes. The shape of the body of the device and of the pretreatment means must therefore conform to this requirement in a manner known to those versed in the art. Preference should be given to rounded and curved shapes.

In addition, the materials of which the device of the invention is made are advantageously the plastics materials already proposed for this type of device, for example polyethylene, polypropylene, polyamide, although this list is not limitative. As those versed in the art are aware, plastics materials are very suitable for this type of device, on the one hand for making connections between the various component parts, for example by mating shapes, and on the other hand in order to withstand the conditions prevailing in the washing machine, namely a temperature which may reach values close to 100° C., in a neutral medium or one having a basic pH.

It will also be noted that, in order not to overburden the description, forms of construction already explained in connection with other variants have not been explained again for each variant. For example, the nozzles or spouts may be provided with means of the type described in connection with FIG. 7A for controlling the flow of detergent liquid during the pretreatment. In addition, the arrangement of the rubbing means on the body of the device is not in any way critical. The surface irregularities may be provided in any suitable position on the bottom or the side walls of the body, including the edge of the flat surface constituting the base.

Similarly, the gripping means may be varied at will. The description of cavities or depressions is purely illustrative. This type of means is easy to produce during the moulding of the body of the device.

With regard to the method of manufacture, injection moulding is very appropriate for plastics materials. In particular it makes it possible to produce a body of a device and the associated pretreatment means in a single operation.

Furthermore, the device of the invention may be used with widely varying formulations of washing products. As an example, a standard formulation of a detergent liquid and three compositions of additives are given in the following table.

| Liquid | detergent | Additives No. 1 | No. 2 | No. 3 |
|---|---|---|---|---|
| Linear alkylbenzene sulphonate | 13 | | | 5 |
| Sodium alkylsulphate | 2 | | | 2 |
| Alkylalcohol ethoxylates | 8 | | | 5 |
| Dodecenylsuccinic acid | | | | |
| Zeolite | | | | 17 |
| Polyacrylate polymer | | | | 4 |
| Citric acid | 3 | | | |
| Sodium citrate | | | 15 | |
| Oleic acid | 2 | | | |
| Perborate (PB1) | | 45 | 45 | 25 |
| Tetraacetylethylenediamine | | 16 | 16 | 9 |
| Diethylenetriamine pentamethylene phosphonic acid | 0.4 | | | |
| Zn phthalocyanine sulphonate | | | 0.04 | 0.015 |
| Protease (4.0 KNPU) | 0.9 | | | 1.25 |
| Amylase (125 KNU/g) | 0.09 | | | |
| Optical brightener | 0.16 | | 0.07 | |
| Silicate | | | | 2 |
| Carbonate | | | | 2 |
| Sulphate | | 39 | 24 | 19 |
| Complement to 100 | 59 | 0 | 0 | 0 |

We claim:

1. A reusable measuring and dispensing device for use in the machine washing of clothes, said device comprising a hollow body closed at one end by a base and adapted to receive a predetermined amount of a product, said hollow body being provided with at least one filling opening and with outlets for distribution of said product, said device being adapted to be placed, together with clothes to be washed, in a drum of a washing machine, wherein said device is progressively emptied of said product during the course of a washing cycle, said device being further provided with means for enabling a user to effect, once said device has been filled, a controlled application of a pretreatment amount of said product to selected areas of said clothes to accomplish a pretreatment of said areas before said washing cycle, said device, containing a residual amount of product remaining after said pretreatment, being introduced into said machine together with said clothes, and in that said pretreatment means forms an integral part of said device.

2. A device according to claim 1, wherein said pretreatment means is adapted to enable a controlled amount of product to be poured onto said areas.

3. A device according to claim 2, wherein said pretreatment means comprises a pouring spout.

4. A device according to claim 3, wherein said pretreatment means comprises a pouring spout leading to the outside of said device and ending in a channel which is in communication with the interior of said device at a location remote from said base.

5. A device according to claim 4, wherein said channel passes substantially radially through a wall of said hollow body.

6. A device according to claim 4, wherein said pouring spout is adjacent to said base.

7. A device according to claim 6, wherein said channel extends within the walls of an assembly attached to said hollow body, capping said filling opening, said channel having a first end which comprises said pouring spout and a second end which communicates with the interior of said hollow body.

8. A device according to claim 6, wherein said pretreatment means comprises means to enable a user to apply treatment by rubbing said areas.

9. A device according to claim 3, wherein a plane defined by said filling opening is inclined relative to a plane defined by said base, and wherein said pouring spout is located remotely from said base.

10. A device according to claim 1, wherein said hollow body is provided with outwardly projecting surface irregularities.

11. A device according to claim 10, wherein said irregularities are provided on said base.

12. A device according to claim 10, wherein said pretreatment means comprises a pouring spout and wherein said irregularities are provided on said hollow body adjacent to said pouring spout.

13. A device according to claim 1, wherein said hollow body is provided with gripping depressions.

14. A device according to claim 1, wherein said hollow body is divided internally by walls so as to prevent accidental discharge of a product which is not desirable for said pretreatment.

15. A device according to claim 1, wherein said hollow body is divided internally by walls which define a plurality of compartments adapted to receive diverse products.

16. A device according to claim 1, wherein said hollow body includes at least one measuring marker.

17. A device according to claim 16, wherein said marker is of adjustable heights relative to said base.

18. Method of utilizing the device according to claim 1, wherein said device is filled with a total amount of liquid detergent prescribed for a wash, a controlled pretreatment amount of said total amount of liquid detergent is applied to selected areas of said clothes with the aid of said pretreatment means, and said device is then placed in said drum of said washing machine together with said clothes, said device containing the residual amount of said liquid detergent remaining after said pretreatment amount is applied to said clothes.

19. Method of utilizing the device according to claim 15, one of said compartments being associated with said pretreatment means, wherein said compartment which is associated with said pretreatment means is filled with a total amount of liquid detergent prescribed for a wash, the other compartments are filled with one or more additives, a controlled pretreatment amount of said total amount of liquid detergent is applied to selected areas of said clothes with the aid of said pretreatment means, and said device is then placed in said drum of said washing machine together with said clothes, said device containing the residual amount of said liquid detergent remaining after said pretreatment amount is applied to said clothes.

20. Process for pretreating and washing clothes in a washing machine, comprising the following steps:

(a) a dosage of the total quantity of liquid detergent to be utilized during a washing cycle is introduced into a measuring and dispensing device;

(b) a dosage of a secondary product to be utilized during said washing cycle is introduced into said device;

(c) said clothes are pretreated with a controlled pretreatment quantity of said liquid detergent dosage contained in said device; and (d) said clothes and said device containing said secondary product and the residual quantity of liquid detergent remaining after said pretreatment quantity is applied to said clothes are placed in a drum of said washing machine, such that said secondary product and said residual quantity of liquid detergent are used for said washing cycle.

* * * * *

UNITED STATES PATENT AND TRADEMARK OFFICE

CERTIFICATE OF CORRECTION

PATENT NO. : 5,388,298

DATED : February 14, 1995

INVENTOR(S) : Rutter, et al.

It is certified that error appears in the above-identified patent and that said Letters Patent is hereby corrected as shown below:

In Col. 5, line 34, "fractions" should read --fraction--.
In Col. 5, line 56 (appears to be line 57 compared with the PTO line numbers as printed on the patent), "this" should read --its--.
In Col. 8, line 9, "one" should read --on--.
In Col. 9, line 30, "an" should read --and--.
In Col. 9, line 43, "bene" should read --been--.
In Col. 11, line 28, "an da" should read --and a--.
In Col. 11, line 67, "130c" should read --130d--.
In Col. 12, line 12, "127c" should read --127d--.
In Col. 12, line 15, "127c" should read --127d--.
In Col. 12, line 18, "130c" should read --130d--.
In Col. 12, line 24, "form" should read --from--.
In Col. 12, line 63, "130 a" should read --130a--.
In Col. 16, line 32 "heights" should read --height--.

Signed and Sealed this

Thirty-first Day of December, 1996

*Attest:*

Bruce Lehman

BRUCE LEHMAN

*Attesting Officer*

*Commissioner of Patents and Trademarks*